US005558127A

United States Patent [19]

Maruyama et al.

[11] Patent Number: 5,558,127

[45] Date of Patent: Sep. 24, 1996

[54] HYDRAULIC PILOT VALVE

[75] Inventors: Jun Maruyama, Yokohama; Seita Hayashi; Suji Hori, both of Oyama; Tadao Karakama, Tokyo, all of Japan

[73] Assignee: Kabushiki Kaisha Komatsu Seisakusho, Tokyo, Japan

[21] Appl. No.: 416,699

[22] PCT Filed: Oct. 9, 1992

[86] PCT No.: PCT/JP92/01318

§ 371 Date: Apr. 10, 1995

§ 102(e) Date: Apr. 10, 1995

[87] PCT Pub. No.: WO94/09278

PCT Pub. Date: Apr. 28, 1994

[51] Int. Cl.[6] ..... F15B 13/08

[52] U.S. Cl. ..... 137/636.1; 137/596.1; 251/285

[58] Field of Search ..... 137/596.1, 636.1, 137/636.2; 251/285

[56] References Cited

U.S. PATENT DOCUMENTS

| | | | |
|---|---|---|---|
| 3,800,615 | 4/1974 | Pilch | 137/636.2 X |
| 4,296,773 | 10/1981 | Harshman et al. | 137/636.2 X |
| 5,184,646 | 2/1993 | Hori et al. | 137/636.2 |

FOREIGN PATENT DOCUMENTS

| | | |
|---|---|---|
| 49-132617 | 12/1974 | Japan . |
| 54-4089 | 2/1979 | Japan . |
| 63-101379 | 7/1988 | Japan . |
| 2-140005 | 11/1990 | Japan . |
| 3-105787 | 11/1991 | Japan . |
| 3-105701 | 11/1991 | Japan . |
| 4-25082 | 2/1992 | Japan . |
| 4-129989 | 11/1992 | Japan . |
| 50-88791 | 7/1995 | Japan . |

*Primary Examiner*—Gerald A. Michalsky
*Attorney, Agent, or Firm*—Richards, Medlock & Andrews

[57] ABSTRACT

A hydraulic pilot valve consisting of a pair of pressure-reducing valves, wherein a stopper which can freely adjust maximum control inputs of operating levers (23, 24) of the hydraulic pilot valve is provided to make maximum pilot pressures output from the pair of pressure-reducing valves freely adjustable. Furthermore, in the hydraulic pilot valve, a stopper member for limiting a maximum control input of an operating lever is fixed to the operating levers (23, 24), so that an operating force during a maximum operation of an operating lever is received by the stopper member. Furthermore, in the hydraulic pilot valve, an erroneous operation due to vibrations and the like is prevented by a damper mechanism (50) interposed between a lever fixed to each of the operating levers (23, 24) and a main body (1) of the valve. Furthermore, a shuttle valve interposed between the output ports of the pressure-reducing valves can simplify the construction of the hydraulic pilot valve for taking out a maximum pilot pressure out of the pilot pressures of the output ports.

16 Claims, 12 Drawing Sheets

HYDRAULIC PILOT VALVE

FIELD OF THE INVENTION

The present invention relates to a hydraulic pilot valve for executing a directional changeover of control valves, or the like, feeding hydraulic oil to cylinders for driving a working unit mounted on construction machinery such as a hydraulic excavator, a wheel-mounted loader, a dump truck, a bulldozer, and the like.

BACKGROUND ART

A pilot operated control valve is known as a control valve to feed hydraulic oil to cylinders of a working unit of a construction machine. A spool, slidable freely between a neutral position and a hydraulic oil feed position, is provided in a main body of such pilot operated control valve. The spool is held at the neutral position by a spring, and pilot hydraulic oil fed to a pilot cylinder causes the spool to slide to the hydraulic oil feed position. For a directional changeover of the pilot operated control valve, a hydraulic pilot valve feeds hydraulic oil to the pilot cylinder of the control valve. Diverse constructions are known for such a hydraulic pilot valve. For example, Japanese Utility Model Registration Application Laid-Open No. 101379/1988 discloses a hydraulic pilot valve wherein a main body thereof is provided with pressure-reducing elements, pistons to actuate the pressure-reducing elements, and a swinging member swingable freely by an operating lever for pressing the pistons, and wherein swinging the operating lever causes the swinging member to press a piston for establishing the state of feeding pilot hydraulic oil to a pilot cylinder of a control valve. In such a hydraulic pilot valve, a stroke end position of the operating lever is determined by the contact of a member with magnetic material, provided on the operating lever and serving as a stopper, with a solenoid. However, when there is an error in a mounting position of the member with magnetic material and the solenoid, the stroke end position of the operating lever is not fixed but varies. This causes the operator to have an unstable sense of operation and a resultant rough operation. Furthermore, since the stroke end position of the operating lever is substantially determined by the stopper, a maximum stroke from the neutral position is fixed. Thus, the maximum strokes of the pistons of the pressure-reducing elements are also fixed, causing the maximum pressures of pilot hydraulic oil being outputted with a plurality of pressure-reducing elements to become the same. This involves a drawback in that it is impossible to change the maximum pressures of pilot hydraulic oil outputted from the pressure-reducing elements as desired.

Furthermore, according to the prior art, in a hydraulic pilot valve which includes a shaft pivotally mounted on a main body of the valve, an arm fixed to the shaft and extending right and left therefrom, and pressure-reducing valves located at the right and left of the shaft and formed in the main body of the valve, the pressure-reducing valves having a pressure-reducing element between input and output ports thereof and including a spool biased by a spring so as to establish a normally shut-off state between the input and output ports, and which further includes pistons, an end of which comes into contact with the arm to press each spool, the arm is locked onto the shaft by means of a knock-pin, so that the operation of the operating lever causes the arm to swing about the shaft and to come into contact with a stopper. However, according to the construction described above, since an operating force of the operating lever is transmitted to the arm through the shaft and the knock-pin, operating the operating lever with a large force causes the knock-pin to fracture. Therefore, the construction described above had a drawback in that if the diameter of the knock-pin is increased to avoid such a problem, the diameter of the shaft is also increased, with a resultant increase in the size of the hydraulic pilot valve. Furthermore, according to the construction described above, a hydraulic pilot valve for a traveling circuit of a hydraulic excavator or the like is mounted on the bottom surface of a floor plate of a cab, and a long operating lever is mounted for convenience of operation by an operator sitting in a seat provided on the floor plate. Accordingly, there arises a very dangerous case where the operating lever moved erroneously due to an inertial force derived from vibrations of the vehicle body or the like, leading to an erroneous operation of the hydraulic pilot valve.

Also, a hydraulic pilot valve is known wherein a plurality of pressure-reducing valves are provided in a main body of the valve and wherein the pressure-reducing valves are operated to externally output a pilot pressure from the pressure-reducing valves. In such a hydraulic pilot valve, when a plurality of pressure-reducing valves are operated concurrently, the highest pilot pressure out of the pilot pressures of the pressure-reducing valves needs to be selected and outputted externally from the main body of the valve. For example, as shown in FIG. 19, the pilot pressures of a plurality of pressure-reducing valves 72, carried in a main body 71 of a hydraulic pilot valve, are connected to a shuttle valve 74, provided separately from the main body 71 of the valve through hoses 75. The pilot valves of the pressure-reducing valves 72 are compared with each other at the shuttle valve 74 to output the highest pilot pressure. Also, as shown in FIG. 20, the output passages 79 are provided which communicate with the output ports 78 of the pressure-reducing valves 77 in a main body of a valve, and the shuttle valves 81 are provided in communicating passages 80, establishing communication between the output passages 79 in order to output the highest pilot pressure. However, in the construction shown in FIG. 19, due to a connection between the main body 71 of the hydraulic pilot valve and the shuttle valve 74 through hoses 75, there is a problem of an oil leak from a hose or nipple connection. As for the construction shown in FIG. 20, due to the many passages 79, 80 formed in the main body 76 of the valve, drilled holes 79, 80 for use as the passages need to be machined from outside the main body 76 of the valve, as shown in FIG. 21. Hence, plugs 82 need to be prepared in order to fill in the many drilled holes 79, 80 for use as the passages. This raises a problem in that the plugs 82 could be a potential source of an oil leak.

DISCLOSURE OF THE INVENTION

The present invention is made to solve the above mentioned problems involved in the prior art.

According to a first aspect of the present invention, there is provided a hydraulic pilot valve which includes a swing shaft pivotally mounted on a main body of the valve, an actuating arm fixed to the swing shaft and extending right and left therefrom, and pressure-reducing valves located at the right and left of the swing shaft and formed in the main body of the valve, the pressure-reducing valves having a pressure-reducing element between input and output ports thereof and including a spool biased by a spring so as to establish a normally shut-off state between the input and output ports, and which further includes pistons, an end of which comes into contact with the actuating arm to press each spool. The hydraulic pilot valve further includes a limit arm fixed to the swing shaft and extending right and left therefrom, an operating lever fixed to the limit arm, and stoppers allowing a maximum control input of the operating lever to be freely adjusted. When the operating lever causes the swing shaft to turn clockwise and counterclockwise in an oscillatory manner, the actuating arm fixed to the swing shaft and extending right and left therefrom presses spools through pistons, an end of which comes into contact with the actuating arm. This causes the spools to move to a communicating state corresponding to the magnitude of the swing of the operating lever against a spring force, establishing the normally shut-off state between the input and output ports of the pressure-reducing valves. Accordingly, a pilot pressure, corresponding to the magnitude of the swing of the operating lever, is outputted from the output ports of the pressure-reducing valves. Furthermore, it is possible to adjust a maximum control input of the operating lever by means of the limit arm, fixed to the swing shaft and extending right and left therefrom, and the stoppers. Since a maximum control input of the operating lever can be modified or adjusted by means of the stoppers, even when there is an error in parts or assembly, an operational stroke end position of the operating lever can be fixed. Thus, the sense of operation can be improved. Moreover, differentiating the stoppers in a limiting magnitude thereof allows an operational stroke end position when the operating lever is operated in one direction to differ from that when the operating lever is operated in the other direction. This allows a maximum pilot pressure outputted from one pressure-reducing valve to differ from that outputted from the other pressure-reducing valve.

According to a second aspect of the present invention, there is provided a hydraulic pilot valve which includes a swing shaft pivotally mounted on a main body of the valve, an actuating arm fixed to the swing shaft and extending right and left therefrom, and pressure-reducing valves located at the right and left of the swing shaft and formed in the main body of the valve, the pressure-reducing valves having a pressure-reducing element between input and output ports thereof and including a spool biased by a spring so as to establish a normally shut-off state between the input and output ports, and which further includes pistons, an end of which comes into contact with the actuating arm to press each spool. The hydraulic pilot valve further includes an operating lever therefor and a stopper member fixed to the operating lever and to the swing shaft to limit a maximum control input of the operating lever. When the operating lever causes the swing shaft to turn clockwise and counterclockwise in an oscillatory manner, the actuating arm fixed to the swing shaft and extending right and left therefrom presses spools through the pistons, an end of which comes into contact with the actuating arm. This causes the spools to move to a communicating state corresponding to the magnitude of the swing of the operating lever against a spring force, establishing the normally shut-off state between the input and output ports of the pressure-reducing valves. Accordingly, a pilot pressure corresponding to a control input of the operating lever is outputted from the output ports of the pressure-reducing valves. Furthermore, since the operating lever is fixed to the stopper member limiting a maximum control input thereof, an operating force of the operating lever is directly transmitted to the stopper member. As a result, no torque is generated between the swing shaft and the actuating arm. Accordingly, in spite of a large operating force; if any, of the operating lever, a fixed portion between the swing shaft and the actuating arm can be simplified and the diameter of the swing shaft can be made smaller, because the operating force is directly transmitted to the stopper member without being transmitted to the fixed portion.

According to a third aspect of the present invention, there is provided a hydraulic pilot valve which includes a swing shaft pivotally mounted on a main body of the valve, an actuating arm fixed to the swing shaft and extending right and left therefrom, and pressure-reducing valves located at the right and left of the swing shaft and formed in the main body of the valve, the pressure-reducing valves having a pressure-reducing element between input and output ports thereof and including a spool biased by a spring so as to establish a normally shut-off state between the input and output ports, and which further includes pistons, an end of which comes into contact with the actuating arm to press each spool. The hydraulic pilot valve further includes a damper mechanism interposed between a lever fixed to the swing shaft and the main body of the valve. When an operating lever causes the swing shaft to turn clockwise and counterclockwise in an oscillatory manner, the actuating arm fixed to the swing shaft and extending right and left therefrom presses spools through pistons, an end of which comes into contact with the actuating arm. This causes the spools to move to a communicating state corresponding to the magnitude of the swing of the operating lever against a spring force, establishing the normally shut-off state between the input and output ports of the pressure-reducing valves. Accordingly, a pilot pressure corresponding to a control input of the operating lever is outputted from the output ports of the pressure-reducing valves. Furthermore, the damper mechanism interposed between the lever fixed to the swing shaft and the main body of the valve can dampen vibrations or the like of the operating lever and actuating arm derived from an external vibrating force. Thus, the operating lever is prevented from operating erroneously due to vibrations of a vehicle body or the like, thereby improving safety. The number of parts of a mounting device for the damper mechanism is reduced, leading to a reduction of costs. The damper mechanism can be assembled concurrently with assembly of the hydraulic pilot valve, thereby simplifying assembly work.

According to a fourth aspect of the present invention, there is provided a hydraulic pilot valve which includes a swing shaft pivotally mounted on a main body of the valve, an actuating arm fixed to the swing shaft and extending right and left, and pressure-reducing valves located at the right and left of the swing shaft and formed in the main body of the valve, the pressure-reducing valves having a pressure-reducing element between input and output ports thereof and including a spool biased by a spring so as to establish a normally shut-off state between the input and output ports, and which further includes pistons, an end of which comes into contact with the actuating arm to press each spool. The hydraulic pilot valve further includes a shuttle valve interposed between output ports of the pressure-reducing valves. When an operating lever causes the swing shaft to turn clockwise and counterclockwise in an oscillatory manner, the actuating arm fixed to the swing shaft and extending right and left therefrom presses spools through pistons, an end of which comes into contact with the actuating arm. This causes the spools to move to a communicating state corresponding to the magnitude of the swing of the operating lever against a spring force, establishing the normally shut-off state between the input and output ports of the pressure-reducing valves. Accordingly, a pilot pressure corresponding to a control input of the operating lever is outputted from the output ports of the pressure-reducing valves. Furthermore, pilot pressures outputted from the output ports of the pressure-reducing valves are compared with each other at the shuttle valve interposed between the output ports in order to output a higher pilot pressure. Thus, when a maximum pilot pressure is to be taken out of pilot pressures outputted from a plurality of pressure-reducing valves, hoses, nipples or plugs and the like become unnecessary, leading to a reduction of costs and sources of oil leak. In addition, in a construction where two sets of the hydraulic pilot valves are arranged together, the swing shafts of the hydraulic pilot valves are coaxial and are arranged in such a manner that ends thereof, on the side of carrying the actuating arms, are opposed in proximity to each other. This allows a hydraulic pilot valve including four pressure-reducing valves to be compact and brings a reduction of costs.

BEST MODE FOR CARRYING OUT THE INVENTION

Figure 1:
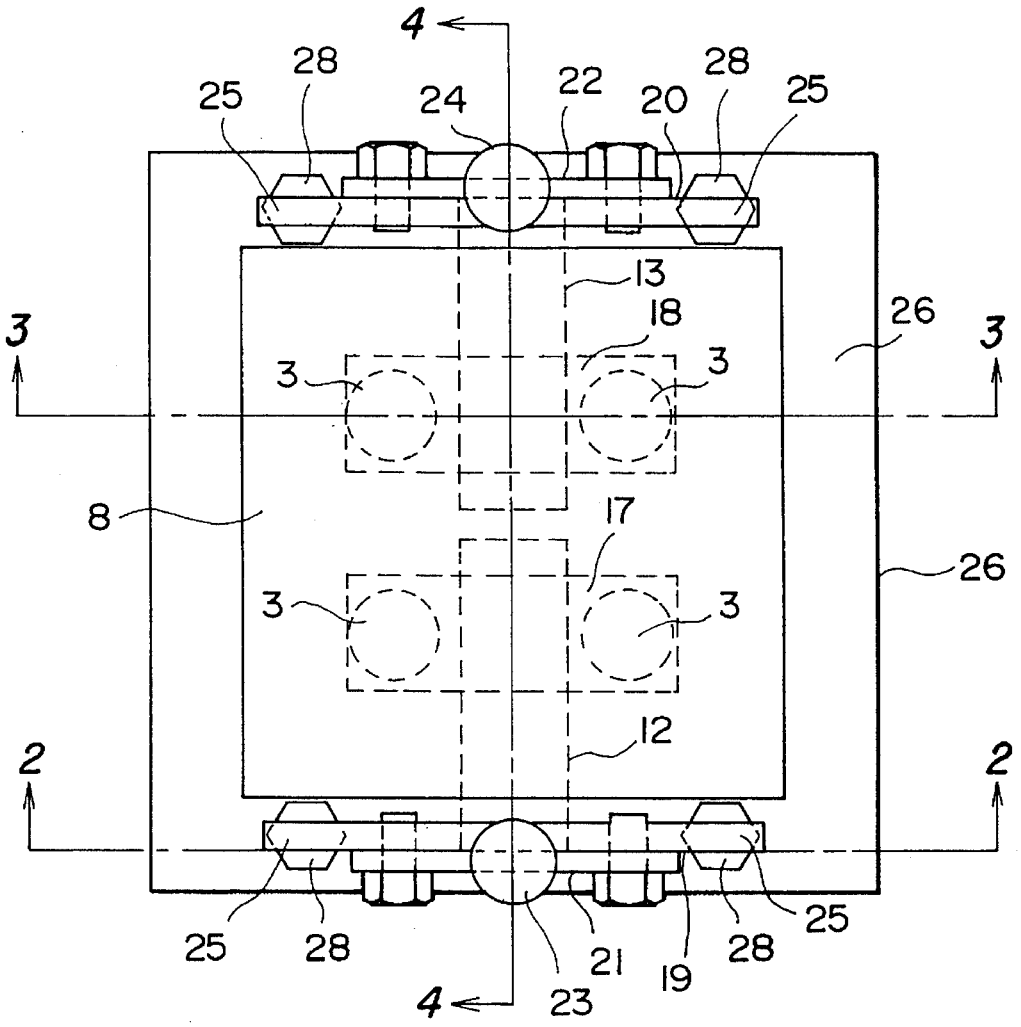
FIG. 1 is a plan view showing a hydraulic pilot valve according to a first embodiment of the present invention.
Figure 2:
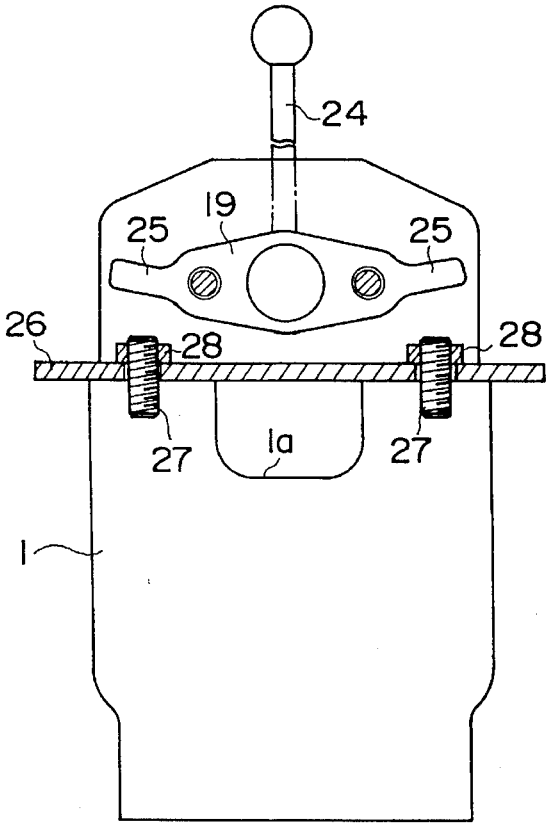
FIG. 2 is a cross-section along the line 2—2 of FIG. 1.
Figure 3:
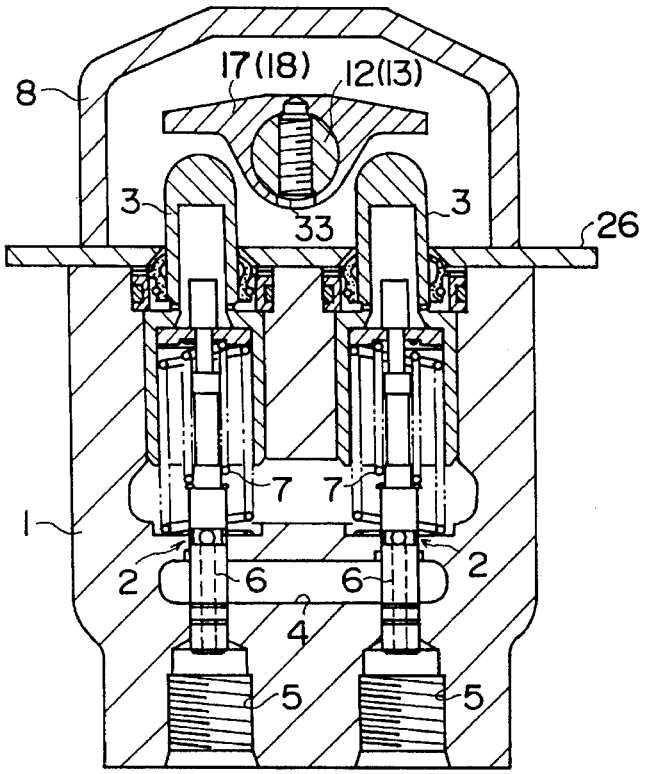
FIG. 3 is a cross-section along the line 3—3 of FIG. 1.
Figure 4:
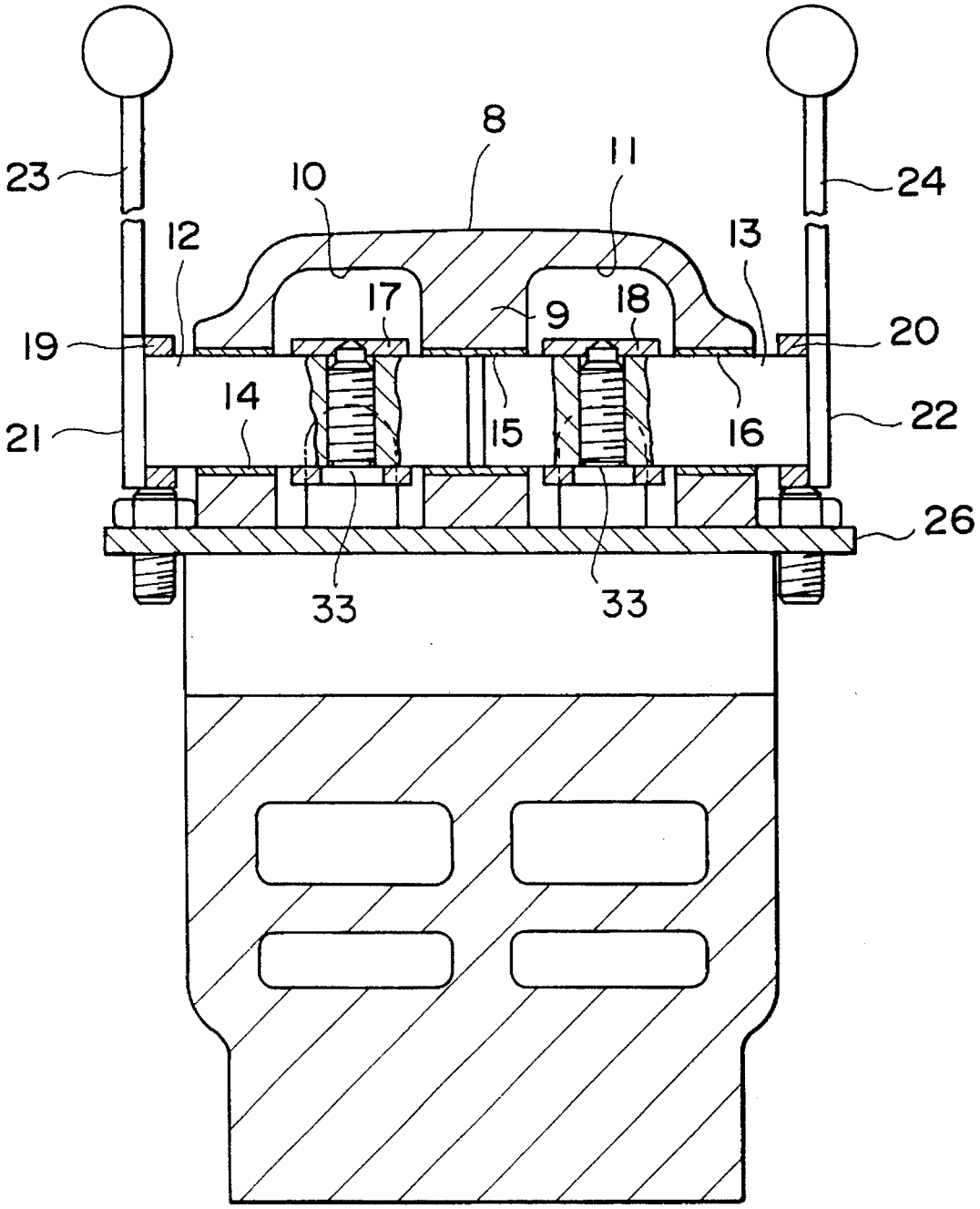
FIG. 4 is a cross-section along the line 4—4 of FIG. 1.

In FIGS. 1–4, showing a first embodiment of the present invention, four pressure-reducing elements 2 and four pistons 3 are provided in a main body 1 of a valve. In the pressure-reducing element 2, a spool 6, which establishes or shuts off communication between an input port 4 and an output port 5, is held at a shut-off position by a spring 7. When the spool 6 is pressed by a piston 3, the spool 6 moves to a communicating position corresponding to the magnitude of the press, thereby allowing a hydraulic pressure of the input port 4 to be outputted from the output port 5. A case 8 is fixed to the main body 1 of the valve at the top portion thereof to form a valve body. The case 8 has first and second recesses 10, 11 separated from each other by a bulkhead 9. Two of the pistons 3 face the first recess 10, and two of the pistons 3 face the second recess 11. First and second swing shafts 12, 13 are rotatably supported in the case 8 by bearings 14–16. A first actuating arm 17 is mounted on the first swing shaft 12, at a portion thereof exposed to the first recess 10, and is arranged so as to press two of the pistons 3, 3. A second actuating arm 18 is mounted on the second swing shaft 13, at a portion thereof exposed to the second recess 11, and is arranged so as to press the two remaining pistons 3, 3. Each of the limit arms 19, 20 is fixed to an end of a respective one of the first and second swing shafts 12, 13. Operating levers 23, 24 are attached to the limit arms 19, 20 through mounting plates 21, 22, respectively. As shown in FIGS. 1 and 2, a pair of projections 25, 25 are integrally provided at the right and left of the limit arms 19, 20. A base 26 for the case 8 is fixed on the top surface of the main body 1 of the valve. Screws 27, 27, serving as stoppers, are screwed into the base 26 and then secured with lock nuts 28, 28.

Next, operations will be described with reference to FIGS. 1–4. As an operator holds the first operating lever 23 and swings it to turn the first swing shaft 12 in either direction, clockwise or counterclockwise, the first actuating arm 17 swings in the same direction. As a result, a spool 6 is pressed downwardly by the piston 3 corresponding to the direction of operation. This causes the spool 6 to move to a communicating position between the input port 4 and the output port 5 in the pressure-reducing element 2 in accordance with the magnitude of the swing of the operating lever 23. Concurrently with the operation, the projection 25 of the limit arm 19 comes into contact with the screw 27 to limit the control input of the operating lever 23. After loosening the lock nut 28, by turning the screw 27 to move it upwardly or downwardly, the magnitude of the swing of the first limit arm 19 is limited accordingly with a resultant limitation on the magnitude of the swing of the first actuating arm 17. Thus, the maximum pilot pressure outputted from the output port 5 can be limited accordingly. When pilot pressures at leftward and rightward operations of the first operating lever 23 need to be equal, a complete match therebetween can be attained by adjusting the right and left paired, opposed screws 27, 27 to overcome any manufacturing errors of the parts. Also, adjusting the right and left paired, opposed screws 27, 27 allows maximum pilot pressures at leftward and rightward operations of the first operating lever 23 to be differentiated from each other as needed.

Figure 5:
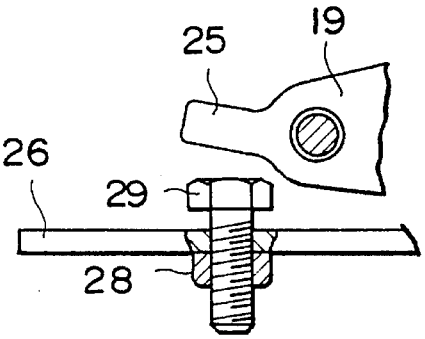
FIG. 5 is a partial view of a hydraulic pilot valve according to a second embodiment of the present invention.

FIG. 5, showing a second embodiment of the present invention, is part of a view corresponding to the view of the first embodiment in FIG. 2. The second embodiment is the same as the first embodiment except that a hexagon headed bolt 29 is used in place of the screw 27 in FIG. 2, with a lock nut 28 screwed thereto at the bottom surface of the base 26 for securing it.

Figure 6:
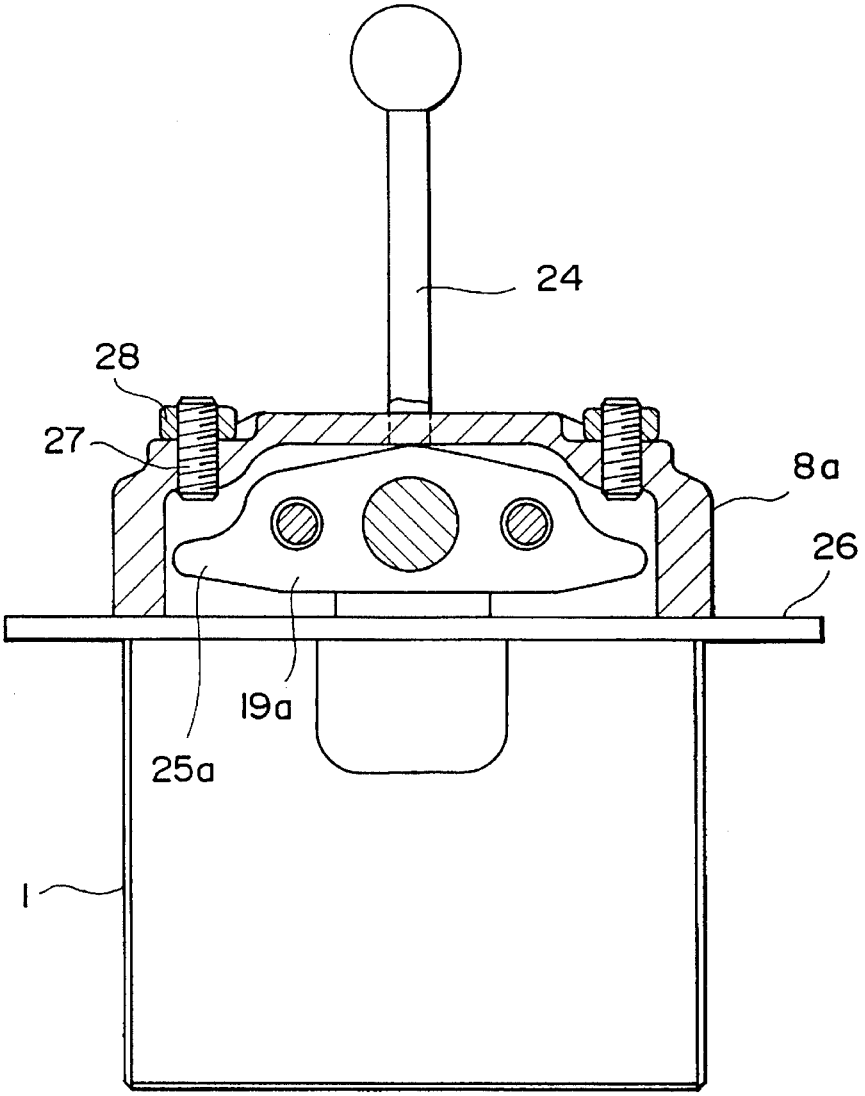
FIG. 6 is a view showing a hydraulic pilot valve according to a third Embodiment of the present invention.

FIG. 6, showing a third embodiment of the present invention, corresponds to FIG. 2 showing the first embodiment. The screw 27 is screwed into a case **8*a* at the top surface thereof and is secured by the lock nut 28. Thus, a projection 25***a* of a limit arm 19*a* comes into contact with an end of the screw 27, thereby limiting the control input of the first operating lever 23. After loosening the lock nut 28, by turning the screw 27 to move it upwardly or downwardly, the magnitude of the swing of the first limit arm 19*a* is limited accordingly, with a resultant limitation on the magnitude of the swing of the first actuating arm 17. Thus, the maximum pilot pressure outputted from the output port 5 can be limited accordingly.

Figure 7:
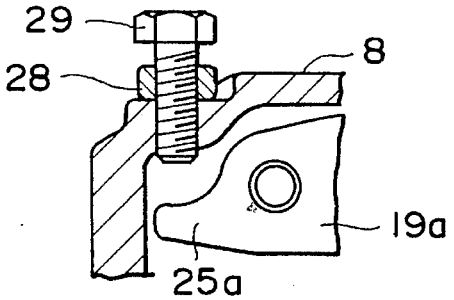
FIG. 7 is a partial view of a hydraulic pilot valve according to a fourth embodiment of the present invention.

FIG. 7, showing a fourth embodiment of the present invention, is part of a view corresponding to FIG. 6. The fourth embodiment is the same as the third embodiment in FIG. 6 except that the hexagon headed bolt 29 is used in place of the screw 27 in FIG. 6, with the lock nut 28 screwed thereto for securing it.

Figure 8:
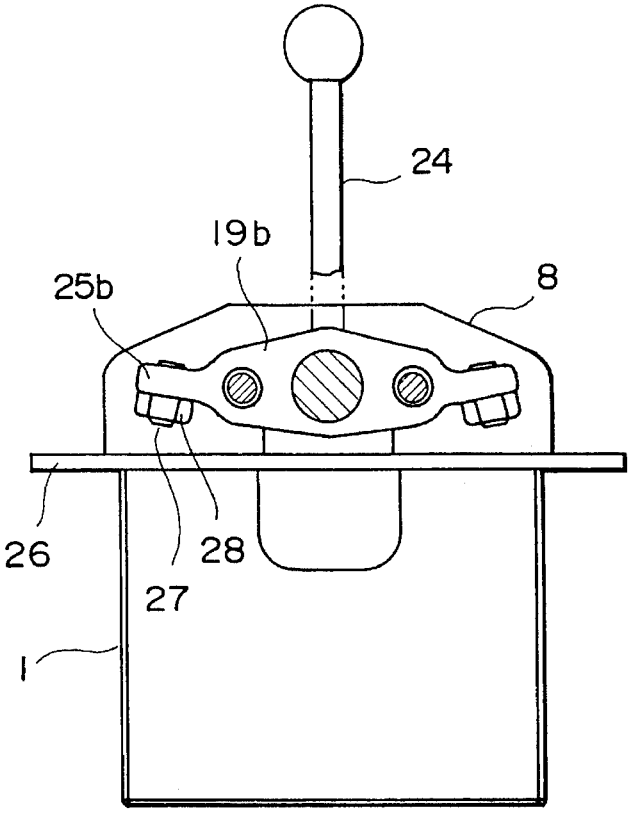
FIG. 8 is a view showing a hydraulic pilot valve according to a fifth embodiment of the present invention.

FIG. 8, showing a fifth embodiment of the present invention, corresponds to FIG. 2. The screw 27 screwed into a projection 25*b* of a limit arm 19*b* is secured by the lock nut 28. An end of the screw 27 comes into contact with the base 26 of the case 8, thereby limiting the control input of the first operating lever 23.

Figure 9:
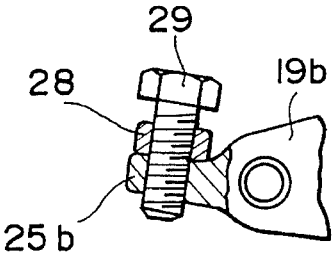
FIG. 9 is a partial view of a hydraulic pilot valve according to a sixth embodiment of the present invention.

FIG. 9, showing a sixth embodiment of the present invention, is part of a view corresponding to FIG. 8. The sixth embodiment is the same as the fifth embodiment in FIG. 8 except that the lock nut 28 is screwed onto the hexagon headed bolt 29 at the top surface of the projection 25*b* of the limiting arm 19*b* for securing the hexagon headed bolt 29.

Figure 10:
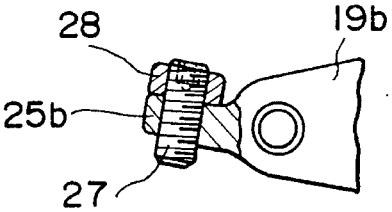
FIG. 10 is a partial view of a hydraulic pilot valve according to a seventh embodiment of the present invention.

FIG. 10 is the same as FIG. 9 except that the screw 27 is used in place of the hexagon headed bolt 29 in FIG. 9.

Figure 11:
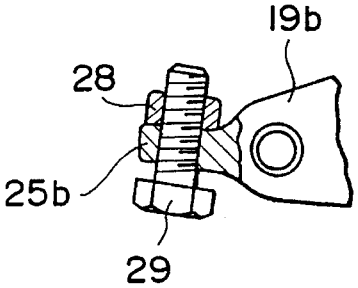
FIG. 11 is a partial view of a hydraulic pilot valve according to an eighth embodiment of the present invention.

FIG. 11, showing an eighth embodiment of the present invention, corresponds to FIG. 9. FIG. 11 is the same as FIG. 9 except that the hexagon head portion of the hexagon headed bolt 29 of FIG. 9 is brought into contact with the base 26 of the case 8 to limit the control input of the first operating lever 23.

The above description of the first through eighth embodiments has only covered operations associated with the first operating lever 23. The operations of the second operating lever 24 are similar to the operations of the first operating lever 23; hence the description of operations thereof is omitted.

Figure 12:
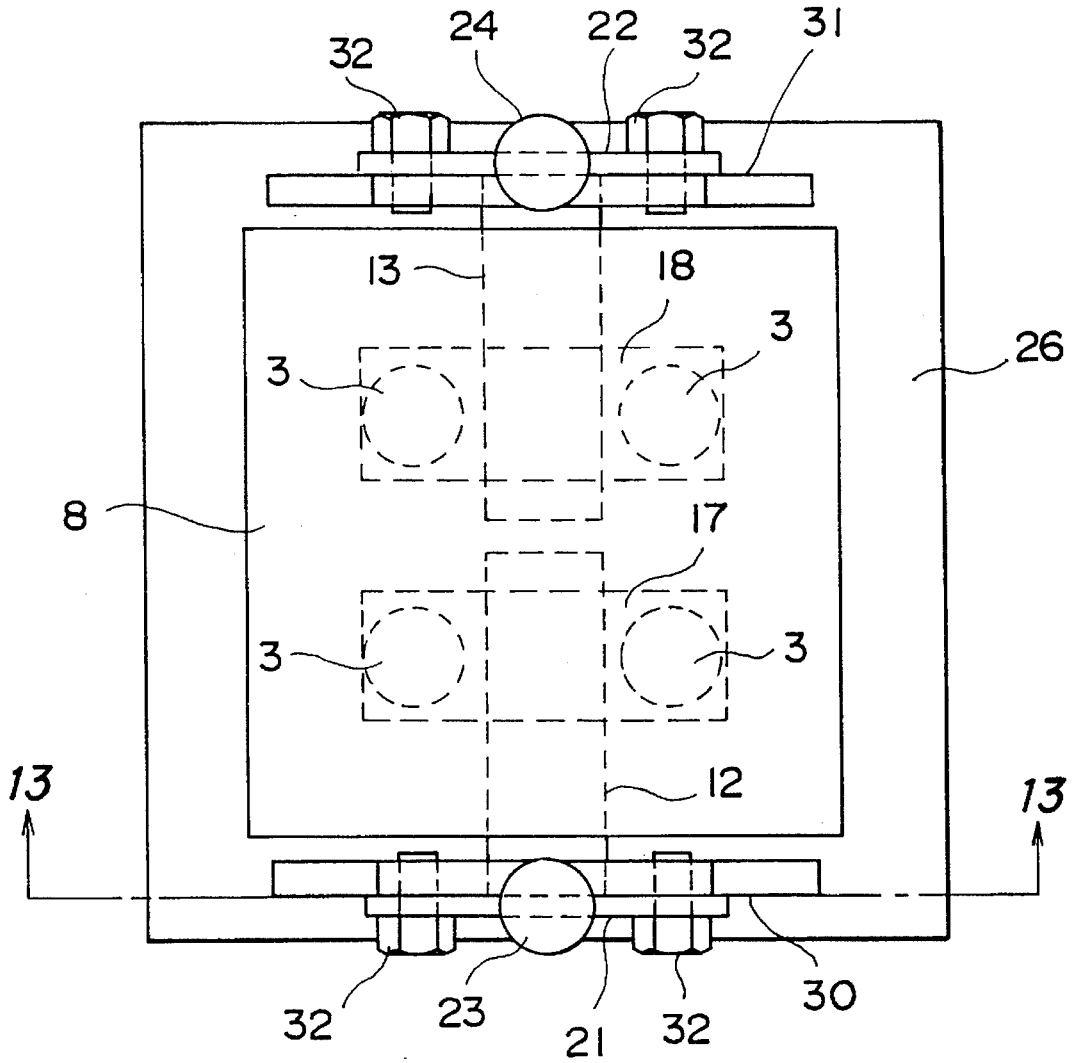
FIG. 12 is a plan view showing a hydraulic pilot valve according to a ninth embodiment of the present invention.
Figure 13:
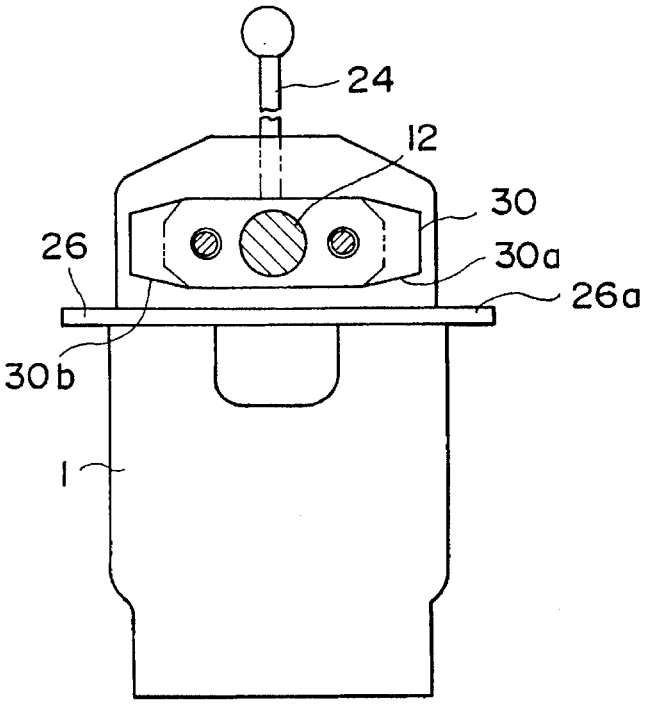
FIG. 13 is a cross-section along the line 13—13 of FIG. 12.
Figure 14:
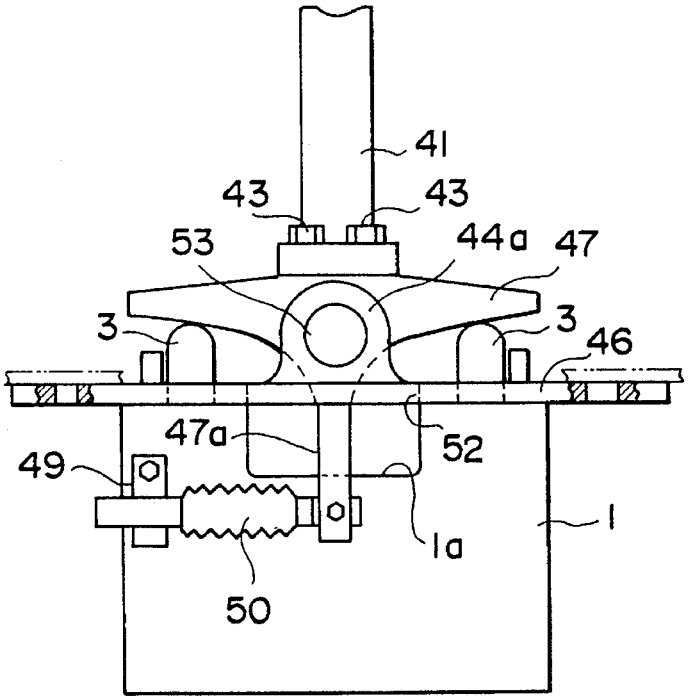
FIG. 14 is a side view showing a hydraulic pilot valve according to a tenth embodiment of the present invention.
Figure 15:
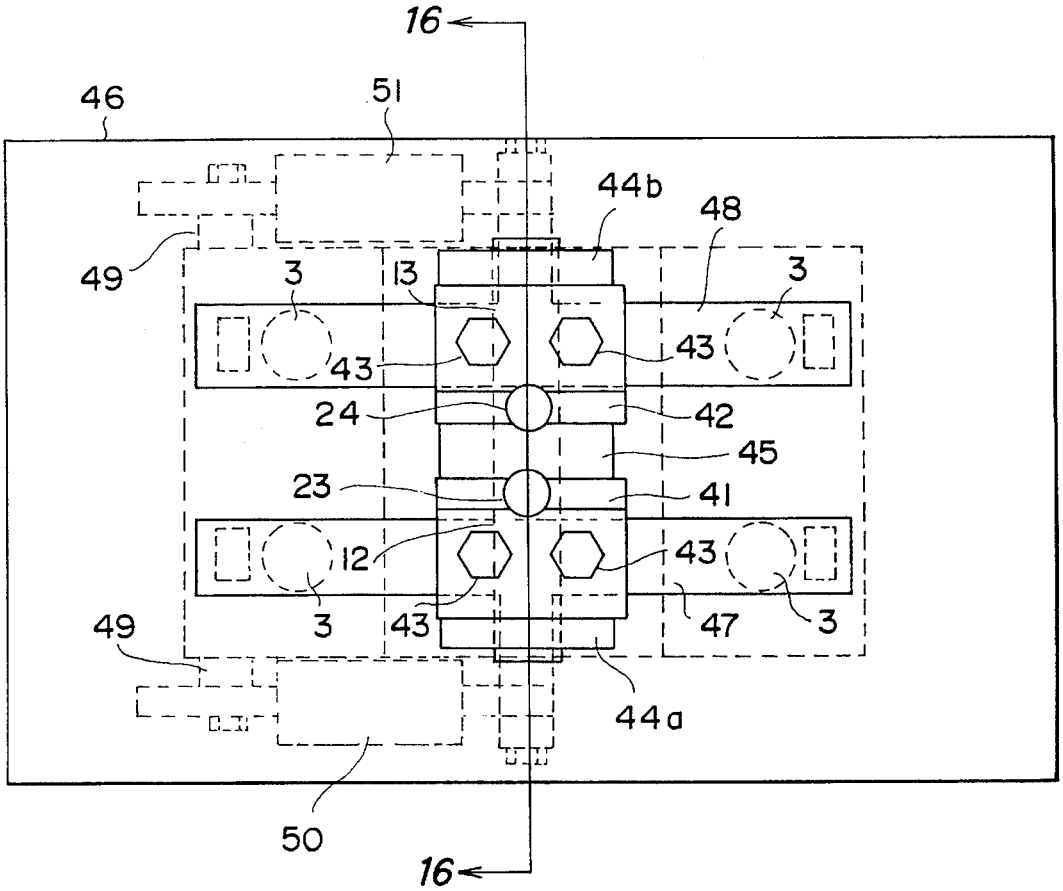
FIG. 15 is a plan view showing a hydraulic pilot valve according to the tenth embodiment of the present invention.
Figure 16:
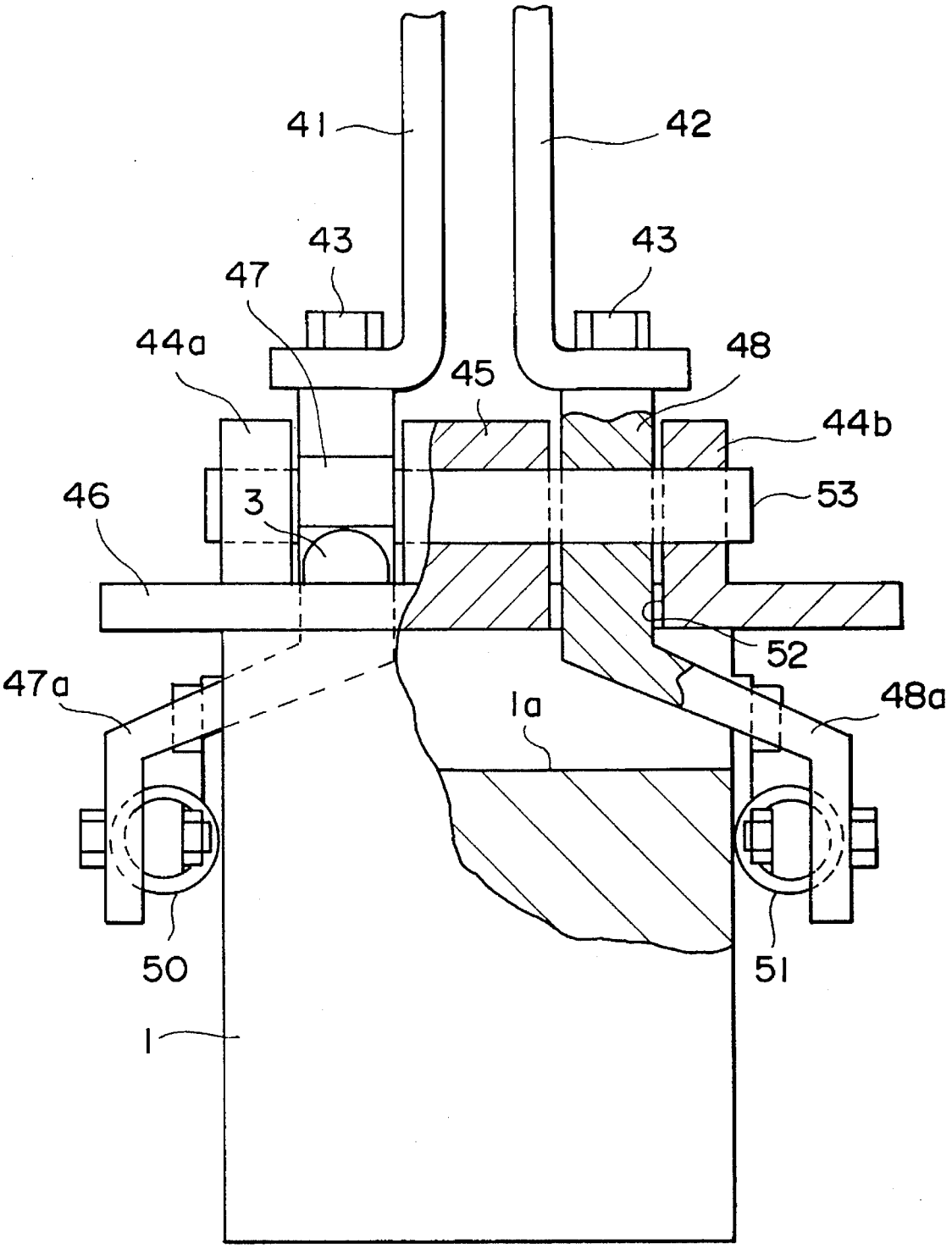
FIG. 16 is a partial cross-section along the line 16—16 of FIG. 15.
Figure 17:
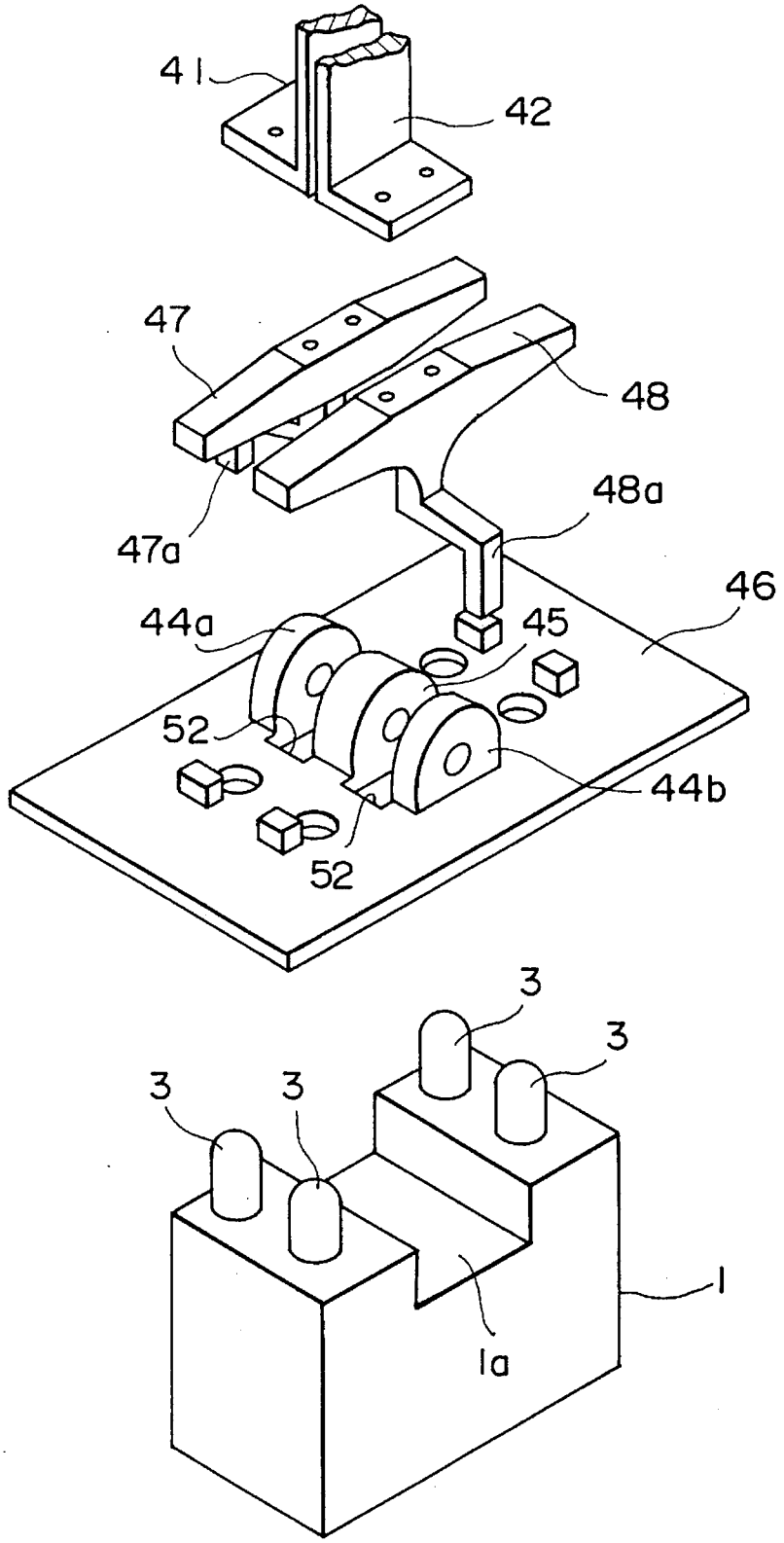
FIG. 17 is an exploded perspective view showing parts of the tenth embodiment.

FIGS. 12 and 13, showing a ninth embodiment of the present invention, correspond to FIGS. 1 and 2, respectively. Parts used in common with FIGS. 1 and 2 are denoted by common reference numerals, and the description thereof is omitted. A first stopper arm 30 is fitted to the first swing shaft 12 at an outer end thereof. The first operating lever 23 is fixed to the first mounting plate 21, which, in turn, is securely fixed to the first stopper arm 30 by two bolts 32, 32. Likewise, a second stopper arm 31 is fitted to the second swing shaft 13 at an outer end thereof, and the second operating lever 24 is fixed to the second mounting plate 22, which, in turn, is securely fixed to the second stopper arm 31 by two bolts 32, 32. Slant bottom faces 30*a*, 30*b* of the first stopper arm 30 are respectively brought in contact with a top surface 26*a* of the base 26, thus forming stopper portions to limit a control input of the first operating lever 23. Likewise, slant bottom faces 31*a*, 31*b*, not shown, of the second stopper arm 31 are respectively brought in contact with the top surface 26*a* of the base 26, thus forming stopper portions to limit a control input of the second operating lever 24.

Next, operations associated only with the first operating lever 23 will be described. The operations of the second operating lever 24 are similar to the operations of the first operating lever 23, and hence the description of the operations thereof is omitted. When the first operating lever 23 is swung, the first stopper arm 30, connected by the two bolts 32, 32 to the first mounting plate 21, swings until either of the slant bottom faces 30*a*, 30*b* comes into contact with the top surface 26*a* of the base 26. With either of the slant bottom faces 30*a*, 30*b* of the first stopper arm 30 being in contact with the top surface 26*a* of the base 26, any attempt to further swing the first operating lever 23 transmits the operating force of the first operating lever 23 to the base 26 through the first mounting plate 21 and the first stopper arm 30, fixed securely thereto by the two bolts 32, 32, with no torque acting on the first swing shaft 12. As a result, no over-force acts on a set screw 33, shown in FIGS. 3 and 4, which locks the first swing shaft 12 and the actuating arm 17 together. This allows the set screw 33 to be very small in diameter or even to be omitted. Thus, the first swing shaft 12 can be made smaller in diameter, leading to a reduction of the size of the entire equipment. Furthermore, since the first stopper arm 30 can be connected to the first swing shaft 12 at an outer end thereof before assembling the hydraulic pilot valve, they can be connected by welding or be formed into an integral part. This significantly increases the connecting strength between the first swing shaft 12 and the first stopper arm 30. In addition, since the first stopper arm 30 also serves as a mounting flange for the first operating lever 23, it allows the first mounting plate 21, which is an integral part of the first operating lever 23, to be mounted thereto easily and securely by the bolts 32, 32. The same is true of the second operating lever 24, the second stopper arm 31, and the second mounting plate 22.

In FIGS. 14–17, showing a tenth embodiment of the present invention, parts used in common with FIGS. 1–4 are denoted by common reference numerals, and the description thereof is omitted. A pair of supporting brackets 44*a*, 44*b* and an intermediate bracket 45 are spaced apart and formed integrally on the base 46 located on the top surface of the main body 1 of the valve. Cutout windows 52, 52 are formed between the supporting brackets 44*a*, 44*b* and the intermediate bracket 45 above the top surface of the main body 1 of the valve so as to open upon a recess 1*a*. A shaft 53 extends through a pair of the supporting brackets 44*a*, 44*b* and the intermediate bracket 45. A pair of actuating arms 47, 48 are pivotally mounted on the shaft 53 at their longitudinal center portions. Both longitudinal ends of the actuating arms 47, 48 are in contact with top ends of the spools 3 shown in FIGS. 1–4. Substantially <-shaped damper mechanism mounting brackets 47*a*, 48*a* extend downward from the longitudinal center portions of the actuating arms 47, 48, respectively. The damper mechanism mounting brackets 47*a*, 48*a* project from the sides of the main body 1 of the valve through the cutout windows 52, 52 and the recess 1*a*. A damper mechanism 50 is pivotally mounted between the damper mechanism mounting bracket 47*a* and a bracket 49 fixed on the side surface of the main body 1 of the valve. Likewise, another damper mechanism 51 is pivotally mounted to the other damper mechanism mounting bracket 48*a*. Furthermore, operating lever mounting brackets 41, 42 are fixed to the top surfaces of the actuating arms 47, 48 at the longitudinal center portions thereof, respectively, by bolts 43, 43.

Next, operations associated only with the first operating lever 23 will be described. The operations of the second operating lever 24 are similar to the operations of the first operating lever 23, and hence the description of operations thereof is omitted. As the first operating lever 23 is swung about the shaft 53, the actuating arm 47 presses the spool 3 down to feed hydraulic pilot oil, and also the damper mechanism mounting bracket 47*a* swings and causes the damper mechanism to expand or contract. Even when there arises a potential erroneous movement of the first operating lever 23, due to an inertial force of the first operating lever 23 caused by vibrations of a vehicle body or the like, an operating force caused by the inertial force is damped by the damper mechanism 50, thereby preventing the first operating lever 23 from operating erroneously. Furthermore, the damper mechanism mounting bracket 47*a* is formed integrally with the actuating arm 47, and the damper mechanism 50 is connected between the damper mechanism mounting bracket 47*a* and the side surface of the main body 1 of the valve. A separate damper mechanism mounting bracket 47*a* or the like, therefore, is not needed. This reduces the number of parts with a resultant reduction of costs. In addition, since the damper mechanism 50 is mounted on the hydraulic pilot valve itself, the damper mechanism 50 is attached concurrently with the assembly of the hydraulic pilot valve, thus reducing man-hours of assembly.

Figure 18:
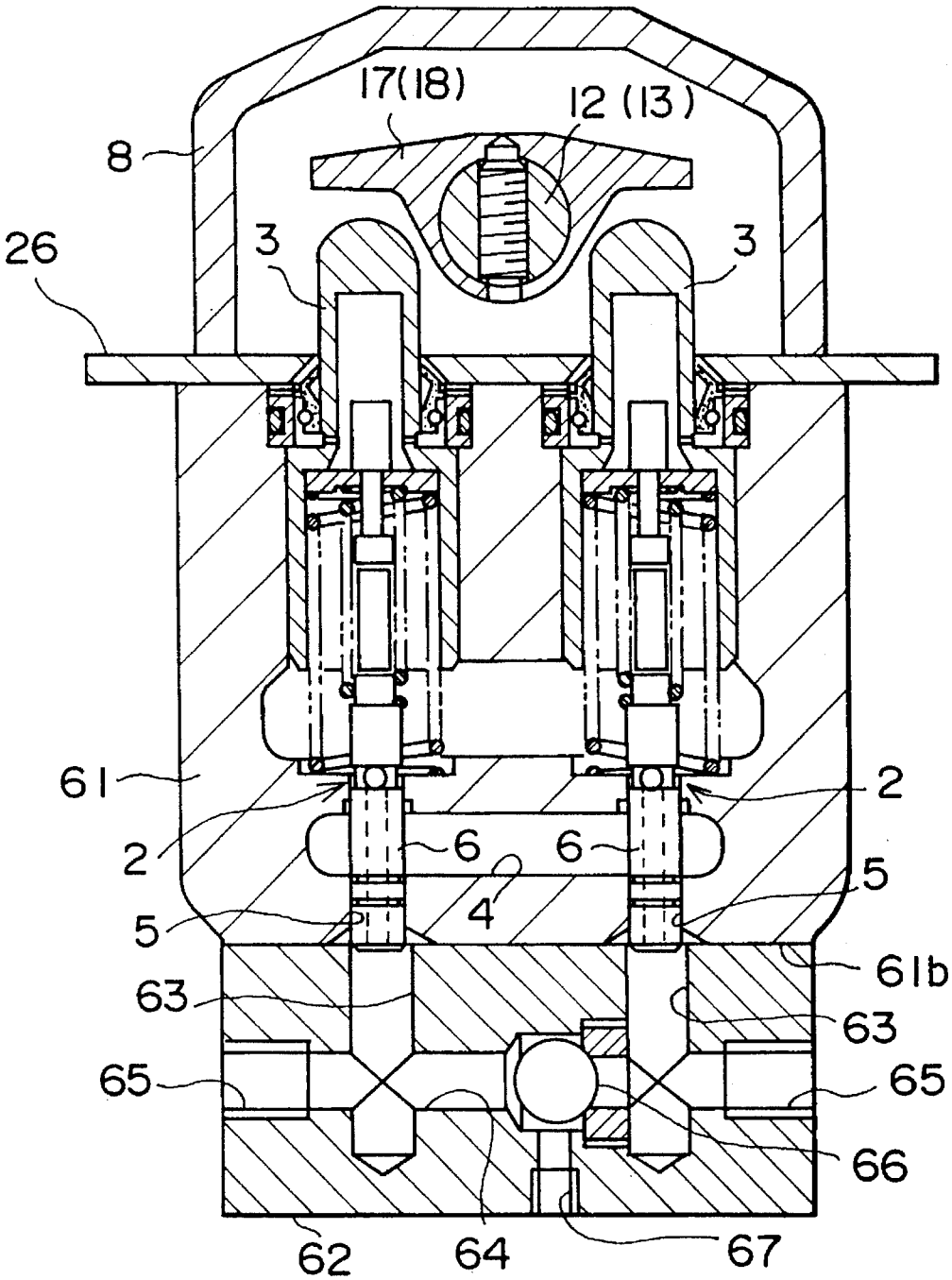
FIG. 18 is a cross-sectional view of a hydraulic pilot valve according to an eleventh embodiment of the present invention and corresponding to FIG. 3.
Figure 19:
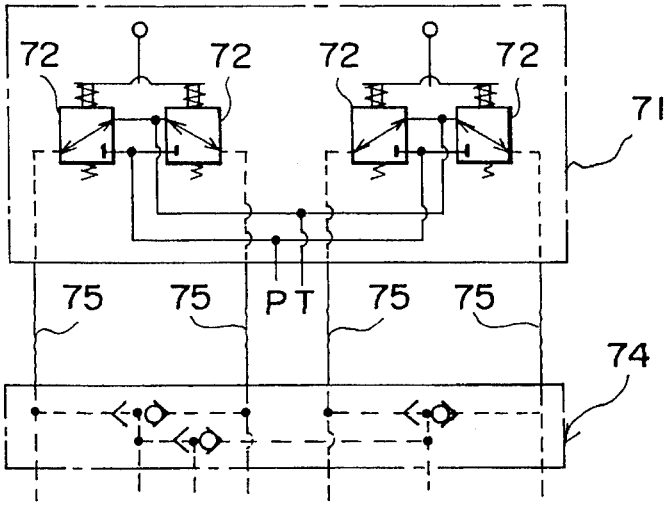
FIG. 19 PRIOR ART
FIG. 19 is a view showing a first example of the prior art.
Figure 20:
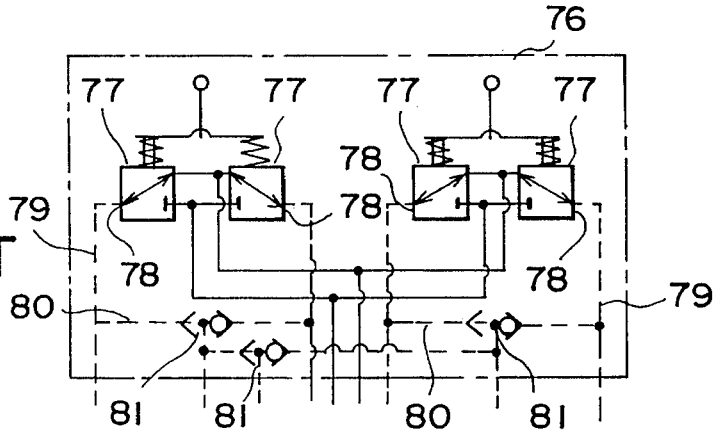
FIG. 20 PRIOR ART
FIG. 20 is a view showing a second example of the prior art.
Figure 21:
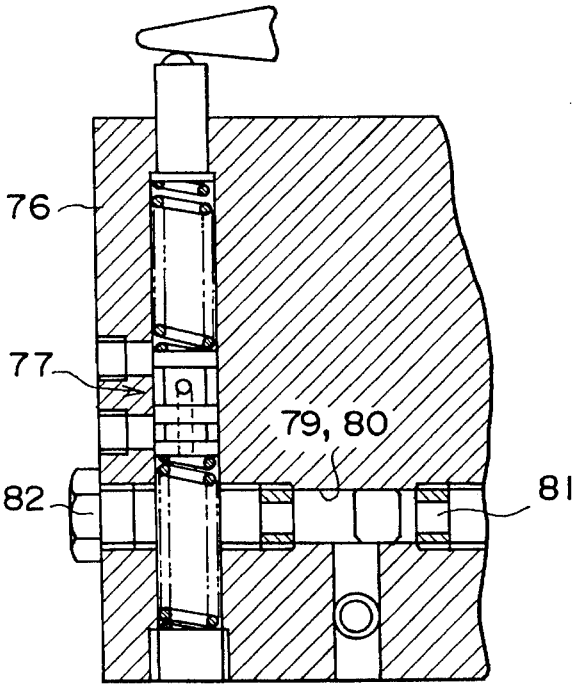
FIG. 21 PRIOR ART
FIG. 21 is a cross-sectional view showing a shuttle valve in FIG. 20.

In FIG. 18, showing an eleventh embodiment of the present invention, parts used in common with FIGS. 1–4 are denoted by common reference numerals, and the description thereof is omitted. A valve block 62 is fixed, using bolts (not shown) or the like, to a main body 61 of a valve at a bottom surface 61*b* thereof where output ports 5, 5 open upon the outside. A plurality of passages 63, 63, communicating with the output ports 5, 5, and a communicating passage 64, for communicating a plurality of the passages 63, 63 with each other, are formed in the valve block 62. Output ports 65, 65 open upon the outside at both ends of the communicating passage 64. A shuttle valve including a ball 66 is formed in the communicating passage 64 between a plurality of the passages 63, 63. The highest one of the pilot pressures of a plurality of the passages 63, 63 is taken out from a maximum pressure output port 67.

Next, operations associated only with the first operating lever 23 will be described. The operations of the second operating lever 24 are similar to the operations of the first operating lever 23, and hence the description of the operation thereof is omitted. Swinging the first operating lever 23 causes the actuating arm 17 to press the spool 3 down. The highest one of the pilot pressures, fed from the output ports 5, 5 to the communicating passage 64 through the plurality of the passages 63, 63, presses the ball 66 to be taken out from the maximum pressure output port 67. Also, respective pilot pressures can be taken out from the output ports 65, 65 communicating with a plurality of the passages 63, 63.

INDUSTRIAL APPLICABILITY

The present invention is effective to serve as a hydraulic pilot valve for executing a directional changeover of control valves, or the like, feeding hydraulic oil to cylinders for driving a working unit mounted on construction machinery such as a hydraulic excavator, a wheel-mounted loader, a dump truck, a bulldozer, and the like.

What is claimed is:

1. A construction comprising:

first and second hydraulic pilot valves, each of said first and second hydraulic pilot valves comprising:

a valve body;

a swing shaft rotatably mounted in said valve body for pivotal motion about a longitudinal axis of said swing shaft between a first direction and a second direction, the second direction being opposite the first direction;

an actuating arm fixed to said swing shaft for rotation therewith, said actuating arm extending in each of said first and second directions from said swing shaft;

first and second pressure-reducing valves formed in said valve body, said first pressure-reducing valve being located in said first direction from said swing shaft while said second pressure-reducing valve is located in said second direction from said swing shaft;

each of said first and second pressure-reducing valves having an input port and an output port, each of said first and second pressure-reducing valves having a pressure-reducing element between the input and output ports thereof, each said pressure-reducing element including an associated spool biased by a spring so as to establish a normally shut-off state between the input and output ports of the respective pressure-reducing valve, each said pressure-reducing element further comprising a piston, an end of which comes into contact with said actuating arm to press a respective associated spool in accordance with a magnitude of rotation of said swing shaft in a respective one of said first and second directions;

a limit arm fixed to said swing shaft for rotation therewith, said limit arm having a first limit arm end portion extending in said first direction from said shaft, said limit arm having a second limit arm end portion extending in said second direction from said swing shaft;

an operating lever connected to said limit arm and to said swing shaft so that said operating lever can be pivoted in either of said first direction with respect to said swing shaft and said second direction with respect to said swing shaft;

a first adjustable stopper mounted on one of said first limit arm end portion and said valve body to provide an adjustable maximum limit for pivotal motion of said operating lever in said first direction; and a second adjustable stopper mounted on one of said second limit arm end portion and said valve body to provide an adjustable maximum limit for pivotal motion of said operating lever in said second direction;

said first and second hydraulic pilot valves being arranged together With the swing shafts of the two hydraulic pilot valves being coaxial, whereby the maximum limit for pivotal motion in the first direction of the operating lever of said first hydraulic pilot valve, the maximum limit for pivotal motion in the second direction of the operating lever of said first hydraulic pilot valve, the maximum limit for pivotal motion in the first direction of the operating lever of said second hydraulic pilot valve, and the maximum limit for pivotal motion in the second direction of the operating lever of said second hydraulic pilot valve can be adjusted to desired values despite errors in the manufacture of either of said first and second hydraulic valves and errors in the assembling of said first and second hydraulic pilot valves in said construction.

2. A construction in accordance with claim 1, wherein said first adjustable stopper is mounted on said first limit arm end portion, and wherein said second adjustable stopper is mounted on said second limit arm end portion.

3. A construction in accordance with claim 2, wherein said first adjustable stopper is a first member adjustably mounted in said first limit arm end portion so that an end of said first member extends outwardly a first adjustable distance from said first limit arm end portion and contacts said valve body when said operating lever is moved a maximum desirable distance in said first direction, and wherein said second adjustable stopper is a second member adjustably mounted in said second limit arm end portion so that an end of said second member extends outwardly a second adjustable distance from said second limit arm end portion and contacts said valve body when said operating lever is moved a maximum desirable distance in said second direction.

4. A construction in accordance with claim 3, wherein each of said first and second members comprises a screw and a lock nut.

5. A construction in accordance with claim 4, wherein each said screw is a bolt.

6. A construction in accordance with claim 3, wherein said first adjustable distance is different from said second adjustable distance.

7. A construction in accordance with claim 3, said first and second hydraulic pilot valves being arranged with the operating lever of the first hydraulic pilot valve being connected to an end of the swing shaft of said first hydraulic pilot valve which is remote from said second hydraulic pilot valve, and with the operating lever of the second hydraulic pilot valve being connected to an end of the swing shaft of said second hydraulic pilot valve which is remote from said first hydraulic pilot valve.

8. A construction in accordance with claim 1, further comprising a set screw which locks said swing shaft and said actuating arm together.

9. A construction in accordance with claim 1, wherein each of said first adjustable stopper and said second adjustable stopper is mounted on said valve body.

10. A construction in accordance with claim 9, wherein said first adjustable stopper is a first member adjustably mounted in said valve body so that an end of said first member extends outwardly a first adjustable distance from said valve body and contacts said first limit arm end portion when said operating lever is moved a maximum desirable distance in said first direction, and wherein said second adjustable stopper is a second member adjustably mounted in said valve body so that an end of said second member extends outwardly a second adjustable distance from said valve body and contacts said second limit arm end portion when said operating lever is moved a maximum desirable distance in said second direction.

11. A construction in accordance with claim 10, wherein each of said first and second members comprises a screw and a lock nut.

12. A construction in accordance with claim 11, wherein each said screw is a bolt.

13. A construction in accordance with claim 10, wherein said first adjustable distance is different from said second adjustable distance.

14. A construction in accordance with claim 10, said first and second hydraulic pilot valves being arranged with the operating lever of the first hydraulic pilot valve being connected to an end of the swing shaft of said first hydraulic pilot valve which is remote from said second hydraulic pilot valve, and with the operating lever of the second hydraulic pilot valve being connected to an end of the swing shaft of said second hydraulic pilot valve which is remote from said first hydraulic pilot valve.

15. A construction in accordance with claim 1, said first and second hydraulic pilot valves being arranged with the operating lever of the first hydraulic pilot valve being connected to an end of the swing shaft of said first hydraulic pilot valve which is remote from said second hydraulic pilot valve, and with the operating lever of the second hydraulic pilot valve being connected to an end of the swing shaft of said second hydraulic pilot valve which is remote from said first hydraulic pilot valve.

16. A construction in accordance with claim 1, wherein each of said first and second hydraulic pilot valves further comprises a shuttle valve interposed between the output ports of the respective one of said first and second pressure-reducing valves.

* * * * *